US010158162B2

(12) United States Patent
Kobayashi et al.

(10) Patent No.: US 10,158,162 B2
(45) Date of Patent: Dec. 18, 2018

(54) AUTOMOTIVE GLASS ANTENNA

(71) Applicant: Central Glass Company, Limited, Ube-shi, Yamaguchi (JP)

(72) Inventors: Hisashi Kobayashi, Matsusaka (JP); Takayuki Suzuki, Mie (JP); Akifumi Kitamura, Matsusaka (JP)

(73) Assignee: Central Glass Company, Limited, Ube-shi (JP)

( * ) Notice: Subject to any disclaimer, the term of this patent is extended or adjusted under 35 U.S.C. 154(b) by 118 days.

(21) Appl. No.: 15/062,467

(22) Filed: Mar. 7, 2016

(65) Prior Publication Data

US 2016/0268670 A1 Sep. 15, 2016

(30) Foreign Application Priority Data

Mar. 9, 2015 (JP) ..... 2015-045711

(51) Int. Cl.
*H01Q 1/12* (2006.01)

(52) U.S. Cl.
CPC ..... *H01Q 1/1278* (2013.01)

(58) Field of Classification Search
CPC ..... H01Q 1/1278
USPC ..... 343/713
See application file for complete search history.

(56) References Cited

U.S. PATENT DOCUMENTS 8,334,813 B2 * 12/2012 Tadokoro ..... H01Q 1/325 343/704
2009/0096690 A1 * 4/2009 Shimo ..... H01Q 1/1271 343/713

FOREIGN PATENT DOCUMENTS

| | | | |
|---|---|---|---|
| JP | 3-65803 | A | 3/1991 |
| JP | 8-139510 | A | 5/1996 |
| JP | 9-153716 | A | 6/1997 |
| JP | 2009-105665 | A | 5/2009 |
| KR | 10-2004-0000513 | A | 1/2004 |

OTHER PUBLICATIONS

Japanese-language Office Action issued in counterpart Japanese Application No. 2015-045711 dated Oct. 16, 2018 with English translation (six (6) pages).

* cited by examiner

*Primary Examiner* — Dameon E Levi
*Assistant Examiner* — David Lotter
(74) *Attorney, Agent, or Firm* — Crowell & Moring LLP

(57) ABSTRACT

An automotive glass antenna includes (a) a defogger having first and second bus bars; (b) a first L-shape auxiliary element connected to a lower end of the first bus bar; (c) a second L-shape auxiliary element connected to an upper end of the second bus bar; (d) a feed point provided at a position near an upper portion of the first bus bar or a lower portion of the second bus bar; and (e) a main element that includes a main vertical element extending along an outside of the first or second bus bar to achieve a capacitive coupling therewith and a main horizontal element extending from the feed point in a substantially horizontal direction. This antenna is capable of receiving FM radio broadcast waves with high gain, even if it is installed in a limited blank space around the defogger.

4 Claims, 10 Drawing Sheets

AUTOMOTIVE GLASS ANTENNA

TECHNICAL FIELD

The present invention relates to an automotive glass antenna, which is formed on a rear window glass equipped with heating conductive strips (defogger), for receiving FM radio broadcast waves, and particularly to a glass antenna that is suitably used in case that the rear window glass is attached to a hatchback-type automobile.

BACKGROUND OF THE INVENTION

In many cases, window glasses (rear window glasses) installed in back doors of hatchback-type automobiles have small areas due to the limitation in design. Therefore, most of such window glass is occupied by the region of the heating strips for securing the rear view when driving in the rain. With this, it becomes necessary to install a glass antenna in a blank space around the periphery of the heating strips on the rear window glass.

The region of the blank space is small. Therefore, in order to improve the gain of glass antenna, the heating strips are also used as an antenna in a manner that the antenna's horizontal strips, vertical strips, etc. arranged around the periphery of the heating strips are positioned adjacent to heating horizontal strips, bus bars, etc. of the heating strips (see U.S. Pat. No. 8,334,813 B2 corresponding to Japanese Patent Application Publication 2009-105665).

SUMMARY OF THE INVENTION

In recent years, there has been a trend in which automobiles of streamline design are preferred. With this, the longitudinal (vertical) dimension of a rear window glass in hatchback-type automobiles becomes short. As a result, the above-mentioned blank space of the rear window glass has become small. This makes it difficult to design a glass antenna for receiving FM radio broadcast waves, which are long in wavelength. There is a task to provide an automotive glass antenna that is capable of receiving FM radio broadcast waves with high sensitivity, even if such glass antenna is installed on a hatchback-type automobile's rear window glass equipped with heating conductive strips (defogger).

It is therefore an object of the present invention to provide an automotive glass antenna that is capable of receiving FM radio broadcast waves with high gain, even if such antenna has been installed in a limited blank space around the peripheral portion of the defogger of an automotive rear window glass.

According to the present invention, there is provided an automotive glass antenna for receiving FM radio broadcast waves to be installed on a hatchback rear window glass, including:

(a) a defogger including horizontal heating strips and first and second bus bars arranged at both end portions of the horizontal heating strips;

(b) a first auxiliary element including:

(1) a first auxiliary horizontal strip that is connected to a lower end of the first bus bar through an extension line and extends along the lowermost horizontal heating strip, and (2) at least one first auxiliary vertical strip that extends upwardly from the first auxiliary horizontal strip in a substantially vertical direction to be outwardly away from the first bus bar;

(c) a second auxiliary element including:

(1) a second auxiliary horizontal strip that is connected to an upper end of the second bus bar through an extension line and extends along the uppermost horizontal heating strip, and (2) at least one second auxiliary vertical strip that extends downwardly from the second auxiliary horizontal strip in a substantially vertical direction to be outwardly away from the second bus bar; and (d) a main element including:

(1) a feed point provided at a position that is near an upper portion of the first bus bar or near a lower portion of the second bus bar, (2) a main vertical element that is connected with the feed point and extends along an outside of the first or second bus bar to achieve a capacitive coupling with the first or second bus bar, and (3) a main horizontal element that extends from the feed point in a substantially horizontal direction.

The above-mentioned "near" on position of the feed point may be defined as having a distance of 3-30 mm from an upper portion (e.g., the upper end) of the first bus bar or from a lower portion (e.g., the lower end) of the second bus bar. In the present invention, unless particularly defined, each strip may have a distance of 25-50 mm from an adjacent strip or bus bar to generate no capacitive coupling.

A main function of the defogger is defogging a hatchback rear window glass of an automobile by energizing the heating strips to heat them. Since the defogger has electric conductivity, it affects reception sensitivity of the antenna for receiving radio waves depending on the defogger's shape or distance from the antenna for receiving radio waves. In the present invention, the defogger is provided with the first and second auxiliary elements, thereby efficiently receiving FM radio broadcast waves through the defogger. FM radio broadcast waves have frequencies of 76-108 MHz (76-90 MHz in Japan and 88-108 MHz in some other countries including USA) and relatively long wavelengths of 3-4 m. For receiving such radio waves, it becomes necessary to provide a relatively long element. In the present invention, as shown in FIG. 1, the first and second auxiliary elements are arranged at positions of the opposite angles of the rectangular defogger. This makes it possible to gain the distance of the element as a whole, which is preferable in receiving FM radio broadcast waves.

Furthermore, in the present invention, as shown in FIG. 1, there is provided the main element having the main vertical element that extends along an outside of the first or second bus bar to achieve a capacitive coupling with the first or second bus bar. Thus, the antenna of the present invention is equipped with the main element and the first and second auxiliary elements. This made it possible to transmit FM radio broadcast waves, which have been received by the defogger and transformed into electric signals, to the FM radio broadcast receiving antenna, thereby increasing reception sensitivity of FM radio broadcast waves. It also becomes possible by the main vertical element to easily receive polarized waves in the vertical direction.

Furthermore, it becomes possible by the first and second auxiliary vertical strips to easily receive polarized waves in the vertical direction. As mentioned above, there has been a trend to shorten the longitudinal (vertical) dimension in hatchback-type automobile's rear window glasses. Even in this trend, it becomes possible by these first and second auxiliary vertical strips to effectively improve reception sensitivity of polarized waves in a vertical direction.

It is possible by the first and second auxiliary horizontal strips to improve reception sensitivity of polarized waves in a horizontal direction.

It is also possible by the main horizontal element to improve reception sensitivity of polarized waves in a horizontal direction.

In the present invention, as shown in FIG. 1, it is important not to provide an auxiliary element at an upper end portion of the first bus bar or at a lower end portion of the second bus bar. If an auxiliary element is provided at such portion (see FIG. 15 of Comparative Example 2), it becomes difficult to gain the distance of the element as a whole. As a result, it becomes difficult to improve reception sensitivity of FM radio broadcast waves.

Advantageous Effect of the Invention

It is possible by the automotive glass antenna of the present invention to receive FM radio broadcast waves with high sensitivity even if this antenna is installed in a limited blank space around the defogger. Therefore, it is possible to preferably apply this antenna to hatchback-type automobile's rear window glasses with shortened longitudinal (vertical) dimension.

DETAILED DESCRIPTION

Each of FIGS. 1-15, 17 and 18 shows an automotive glass antenna 1 viewed from the interior of an automobile.

1. Defogger

Figure 1:
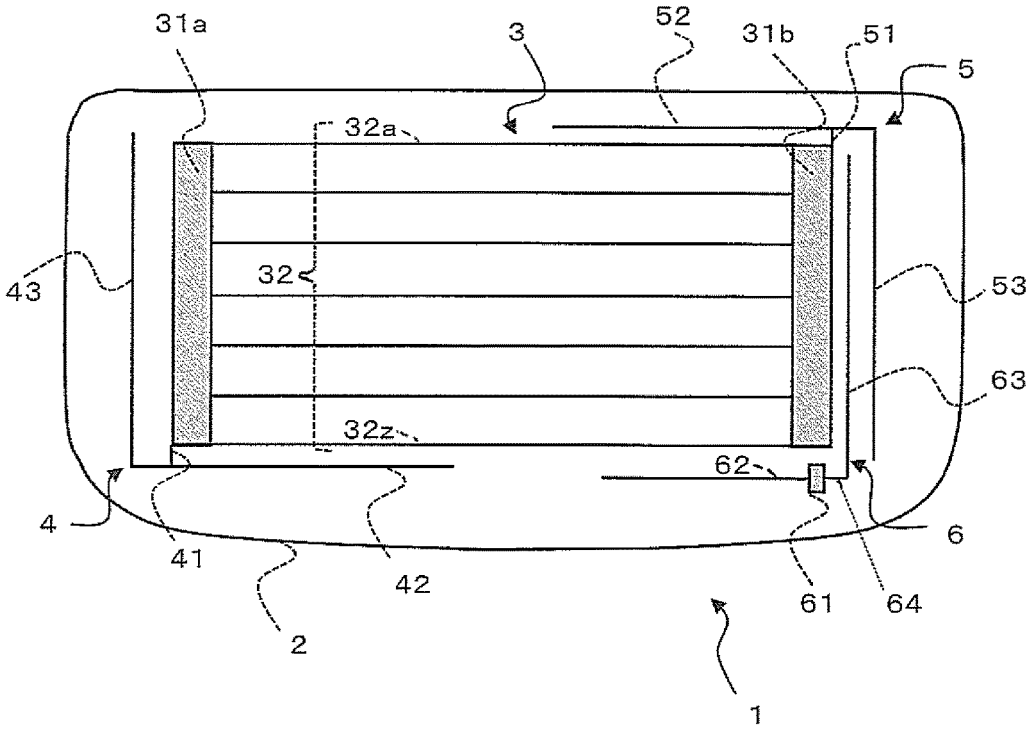
FIG. 1 is a schematic view showing a basic structure of the glass antenna of the present invention, in which the main element is provided on the side of the second auxiliary element.

For example, as shown in FIG. 1, a defogger 3 with a rectangular shape is formed on a window glass 2 installed in a back door of a hatchback-type automobile. The defogger 3 as a rectangle occupies preferably 50-90%, more preferably 60-80%, of the total area of the major surface of the window glass 2. The defogger 3 is formed on its left and right sides with first and second bus bars 31*a*, 31*b*, respectively. The width of each bus bar is set preferably at 5-50 mm. The bus bars 31*a*, 31*b* may have a rectangular shape or flat spindle shape. In the case of a flat spindle shape, the width of the bus bar is measured at the center in the longitudinal direction. The length of the bus bar is preferably 50-90% of the length of the window glass 2 in the vertical direction.

In a hatchback-type rear door, it is common to set the area of window glass at 0.6-1.2 $m^2$ and the length of window glass in the vertical direction at 0.7-1.0 m. Thus, the size of the window glass 2 becomes relatively small. In order to secure the rear view when driving in the rain or the like, it is necessary to make the defogger 3 have the above-mentioned area and percentage of length in the vertical direction. As a result, it can be recognized that a blank space for providing a glass antenna except the defogger 3 is very limited, as shown in FIG. 1.

Figure 12:
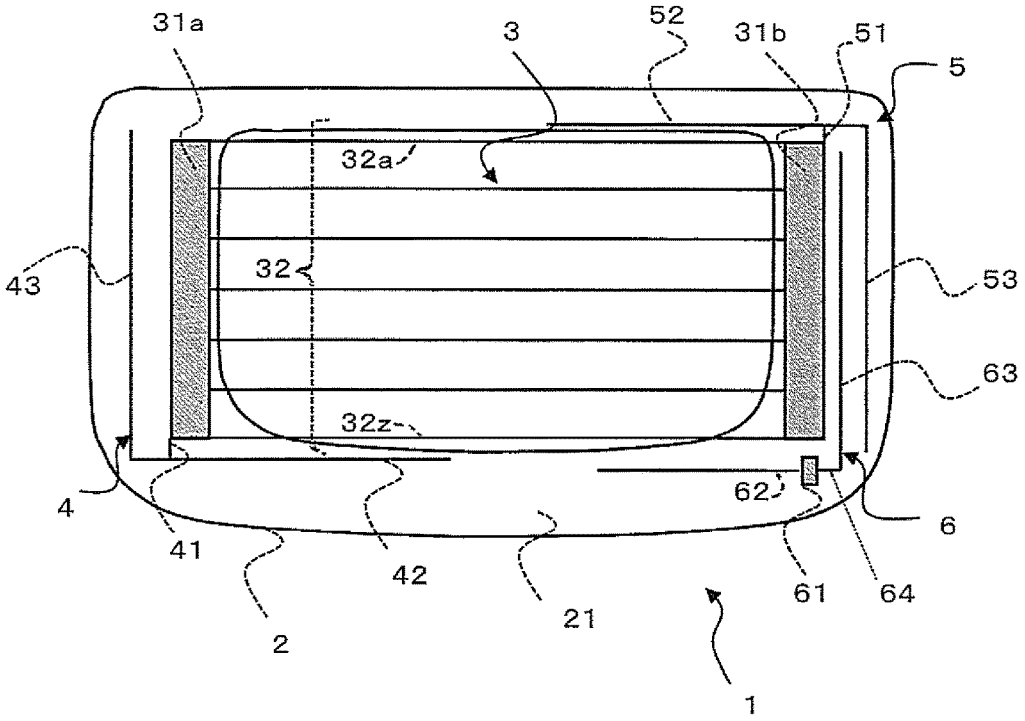
FIG. 12 is a schematic view showing a glass antenna of Example 1.
Figure 13:
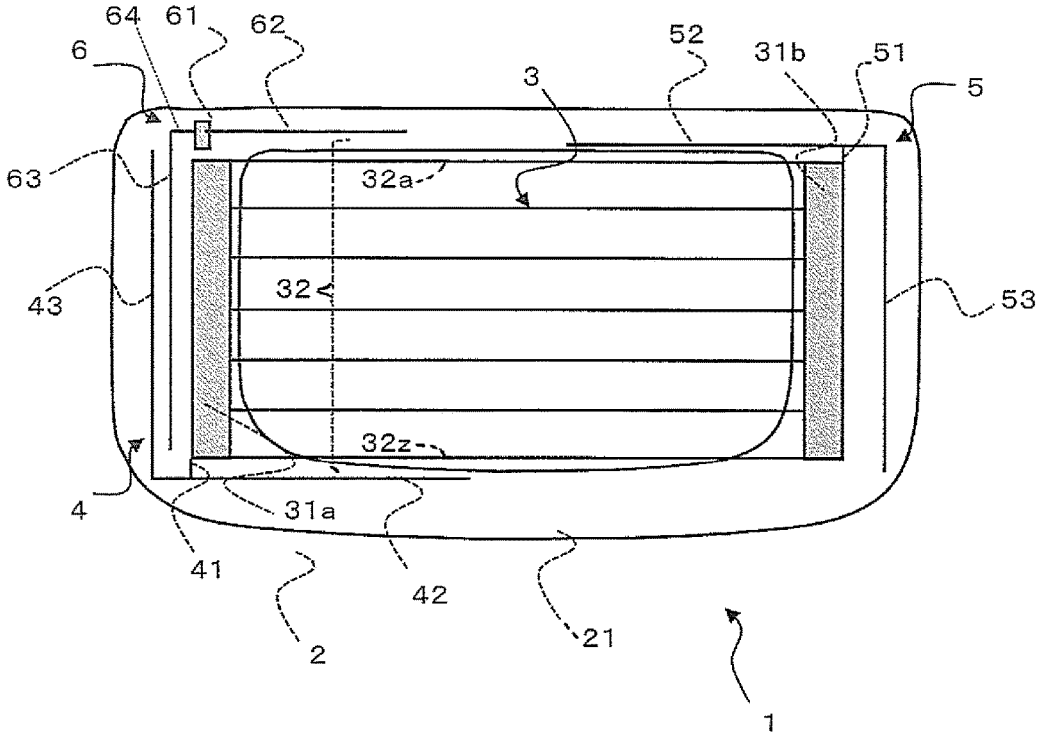
FIG. 13 is a schematic view showing a glass antenna of Example 2.

As the window glass 2, it is possible to use a glass prepared by a three dimensional bending process to have a curved shape that is convex toward the car exterior. As shown in FIGS. 12 and 13, it is preferable to form a black frame 21 colored with a black-color ceramic, in an inner peripheral portion of the window glass 2. It is optional to arrange members (e.g., the bus bars 31*a*, 31*b*, first and second auxiliary elements 4, 5, and main element 6) of the glass antenna 1 within the region of the black frame 21. With this, it becomes possible to make these members inconspicuous to occupants of the automobile, etc.

As shown in FIG. 1, the bus bars 31*a*, 31*b* are connected with each other by a plurality of horizontal heating strips 32 stretching therebetween. The uppermost and lowermost horizontal heating strips are respectively represented by reference numerals of 32*a* and 32*z*. The thickness of each horizontal heating strip 32 is preferably 0.1-2 mm. The distance between adjacent two horizontal heating strips 32 is preferably 30-70 mm, more preferably 40-60 mm, from the viewpoint of securing the rear view when driving in the rain or the like and from the viewpoint of securing the rear visibility. It is preferable to make the distance between each adjacent two horizontal heating strips 32 the same.

Figure 2:
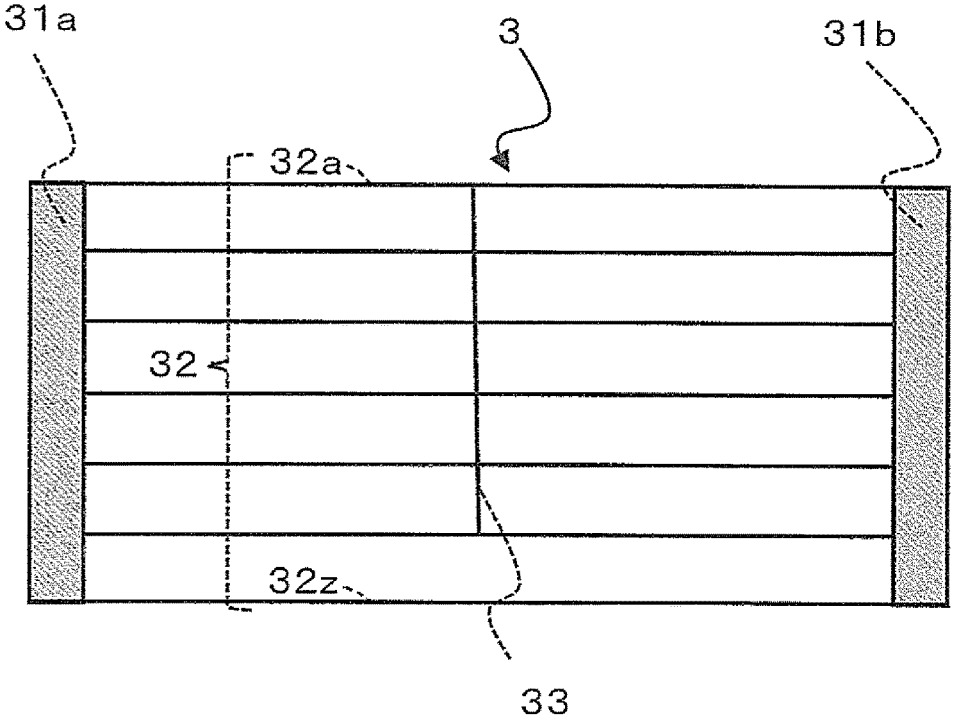
FIG. 2 is a schematic view showing an exemplary structure of the defogger.
Figure 3:
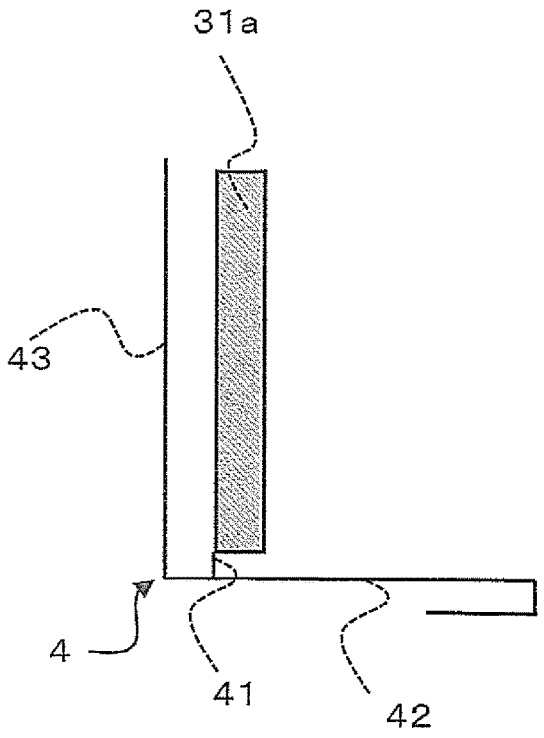
FIG. 3 is a schematic view showing a modification of the first auxiliary horizontal strip in the first auxiliary element.

As shown in FIG. 2, the defogger 3 may be equipped with at least one vertical heating strip 33 that connects with the horizontal heating strips 32. By being equipped with the vertical heating strip 33, not only the reception sensitivity of polarized waves in the vertical direction is improved, but also the reception sensitivity of the FM radio broadcast wave band (88-108 MHz) in foreign countries such as USA seems to be improved. Since the defogger 3 is equipped with the first and second auxiliary elements 4, 5, a combination of these members is not bilaterally symmetrical, as shown in FIG. 1. As shown in FIG. 2, it is preferable that the vertical heating strip 33 connects with the horizontal heating strips 32 except the lowermost horizontal heating strip 32*z*, in order to efficiently defog the window by energizing the heating strips to heat them.

A terminal (not shown in the drawings) is installed on each of the first and second bus bars 31*a*, 31*b* by a method such as soldering. When installing the window glass 2 in a hatchback-type rear door, the defogger 3 is connected to a power supply means through wiring.

2. Auxiliary Elements

As shown in FIG. 1, the defogger is equipped with the first and second auxiliary elements 4, 5. The first auxiliary element 4 is connected to the first bus bar 31*a* through an extension line 41 stemming from the lower end of the first bus bar 31*a*. It has a first auxiliary horizontal strip 42 extending along the lowermost horizontal heating strip 32*z* and at least one first auxiliary vertical strip 43 that extends upwardly from the first auxiliary horizontal strip 42 in a substantially vertical direction to be outwardly away from the first bus bar 31*a*. The electric field is more concentrated in the bus bars 31*a*, 31*b* than in the horizontal and vertical strips 32, 33 of the defogger 3. Therefore, it becomes possible to more improve the reception sensitivity of FM radio broadcast waves by having the extension line 41 stem from the first bus bar 31*a* than from the lowermost horizontal heating strip 32*z*. The extension line 41 stems preferably from the exact base (lower end) of the first bus bar 31*a* as shown in FIG. 1, but may stem from a base (lower end) region of the first bus bar 31*a* having 10 mm (preferably 5 mm) height from its base. In other words, the lower end of the first bus bar 31*a* as the starting point of the extension line 41 may include the above-mentioned lower end region of the first bus bar 31*a*. Although the extension line 41 extends in the vertical direction, it may extend in the horizontal direction.

The second auxiliary element 5 is connected to the second bus bar 31*b* through an extension line 51 stemming from the upper end of the second bus bar 31*b*. It has a second auxiliary horizontal strip 52 extending along the uppermost horizontal heating strip 32*a* and at least one second auxiliary vertical strip 53 that extends downwardly from the second auxiliary horizontal strip 52 in a substantially vertical direction to be outwardly away from the second bus bar 31*b*. The electric field is more concentrated in the bus bars 31*a*, 31*b* than in the horizontal and vertical strips 32, 33 of the defogger 3. Therefore, it becomes possible to more improve the reception sensitivity of FM radio broadcast waves by having the extension line 51 stem from the second bus bar 31*b* than from the uppermost horizontal heating strip 32*a*. The extension line 51 stems preferably from the exact top of the second bus bar 31*b* as shown in FIG. 1, but may stem from an upper end region of the second bus bar 31*b* having 10 mm (preferably 5 mm) height from its top. In other words, the upper end of the second bus bar 31*b* as the starting point of the extension line 51 may include the above-mentioned upper end region of the second bus bar 31*b*. Although the extension line 51 extends in the vertical direction, it may extend in the horizontal direction.

Each length of the first and second auxiliary vertical strips 43, 53 and the first and second auxiliary horizontal strips 42, 52 is suitably adjusted in view of the target wavelengths of FM radio broadcast waves to be received and the size of the defogger 3 and is preferably set within a range of about 300 mm to about 700 mm. It is preferable to have a distance of 3-15 mm between the first auxiliary horizontal strip 42 and the lowermost horizontal heating strip 32*z* or between the second auxiliary horizontal strip 52 and the uppermost horizontal heating strip 32*a*. This will generate a capacitive coupling therebetween, thereby improving the reception sensitivity of the glass antenna of the present invention.

Figure 4:
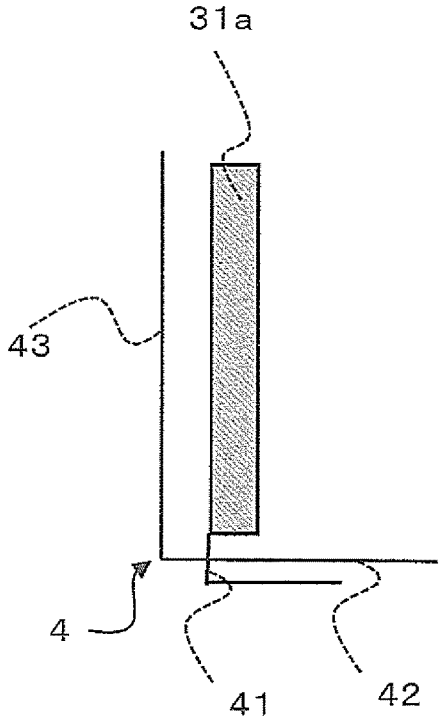
FIG. 4 is a schematic view showing another modification of the first auxiliary horizontal strip in the first auxiliary element.
Figure 5:
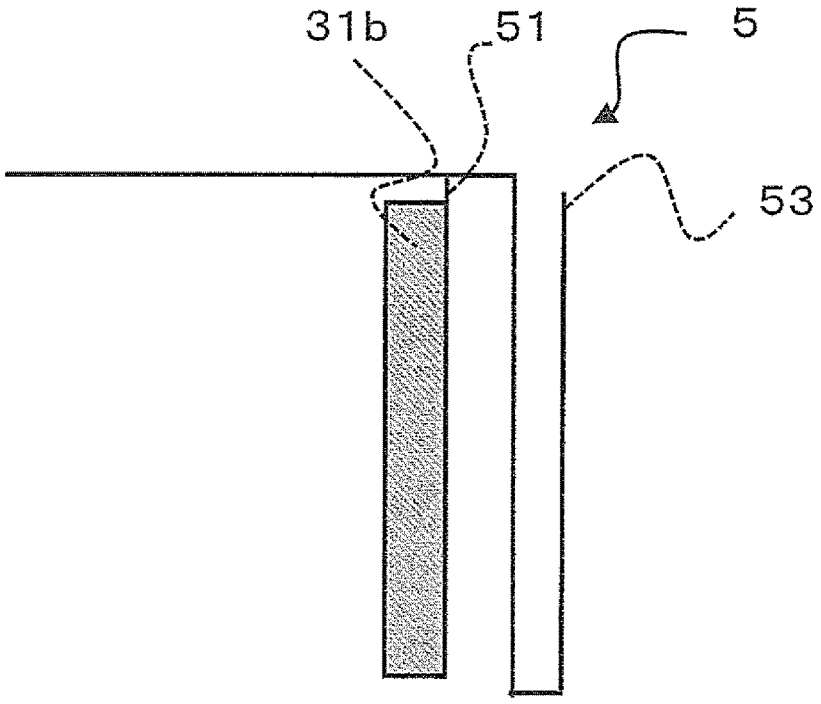
FIG. 5 is a schematic view showing a modification of the second auxiliary vertical strip in the second auxiliary element.
Figure 6:
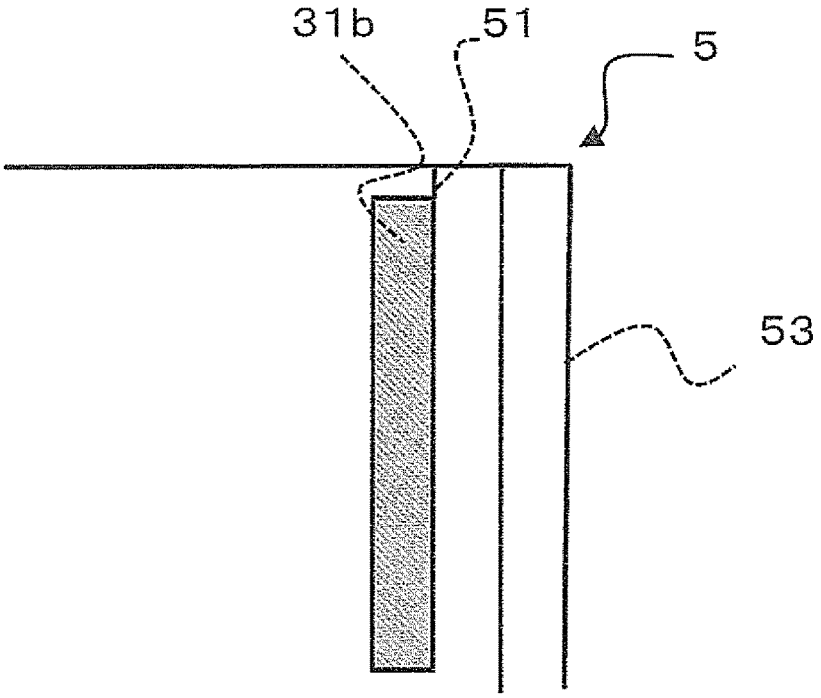
FIG. 6 is a schematic view showing another modification of the second auxiliary vertical strip in the second auxiliary element.

The first auxiliary horizontal strip 42 may be bent and furthermore folded back (see FIG. 3) and/or may be provided by a plural number (see FIG. 4). Similarly, the second auxiliary horizontal strip 52 may be bent and furthermore folded back and/or may be provided by a plural number. In this case, the configuration of the second auxiliary horizontal strip 52 can be obtained by rotating the first auxiliary horizontal strip 42 in FIG. 3 or FIG. 4 by 180 degrees. The distance between the parallel strips within the first or second auxiliary horizontal strip 42, 52 bent and further folded back and/or provided by a plural number is preferably from 10 mm to 60 mm.

It is preferable to have a distance of 3-15 mm between the first or second auxiliary vertical strip 43, 53 and an element that extends in the vertical direction and is nearest to the first or second auxiliary vertical strip 43, 53. This element can be defined as being the first or second bus bar 31*a*, 31*b* or an L-shape (third auxiliary) element 7 (see FIGS. 7 and 11). In this case, the distance of 3-15 mm will generate a capacitive coupling therebetween, thereby improving the reception sensitivity of the glass antenna of the present invention.

It is also preferable to have a distance of 3-15 mm between the first or second auxiliary vertical strip 43, 53 and an element that extends in the vertical direction and is nearest to the first or second auxiliary vertical strip 43, 53. This element can be defined as being a main vertical element 63. In this case, it is preferable that a strip opposite to the main vertical element 63 has a length of 10-200 mm. By having the distance of 3-15 mm therebetween, the main vertical element 63 is capable of receiving electric signals of FM radio broadcast waves received by the defogger 3 through capacitive coupling, thereby improving the reception sensitivity of the glass antenna of the present invention.

Figure 10:
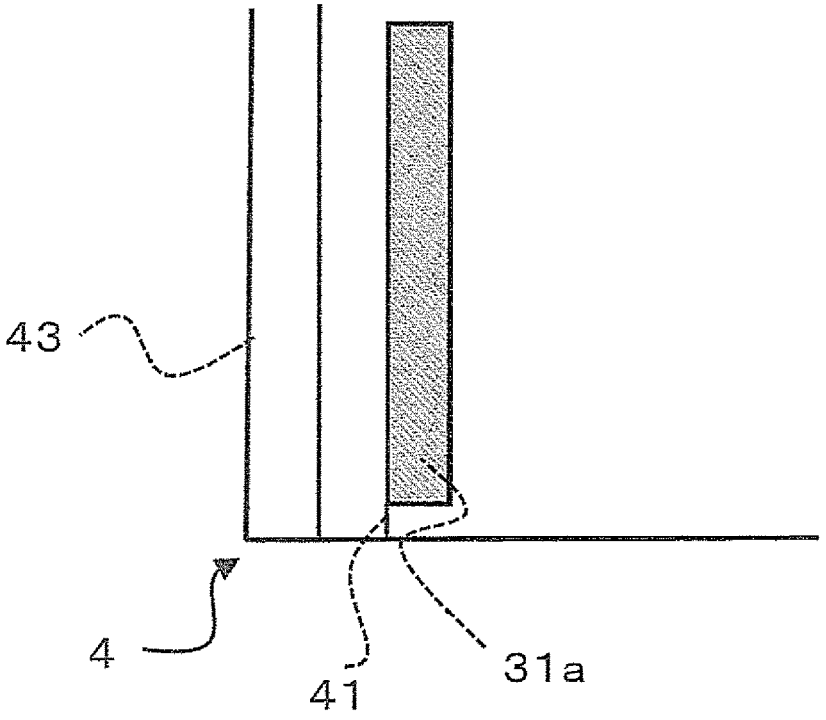
FIG. 10 is a schematic view showing another modification of the first auxiliary vertical strip in the first auxiliary element.

The first auxiliary vertical strip 43 may be bent and furthermore folded back (see FIG. 9) and/or may be provided by a plural number (see FIG. 10). Similarly, the second auxiliary vertical strip 53 may be bent and furthermore folded back (see FIG. 5) and/or may be provided by a plural number (see FIG. 6). The distance between the parallel strips within the first or second auxiliary vertical strip 43, 53 bent and further folded back and/or provided by a plural number is preferably from 10 mm to 60 mm.

Figure 7:
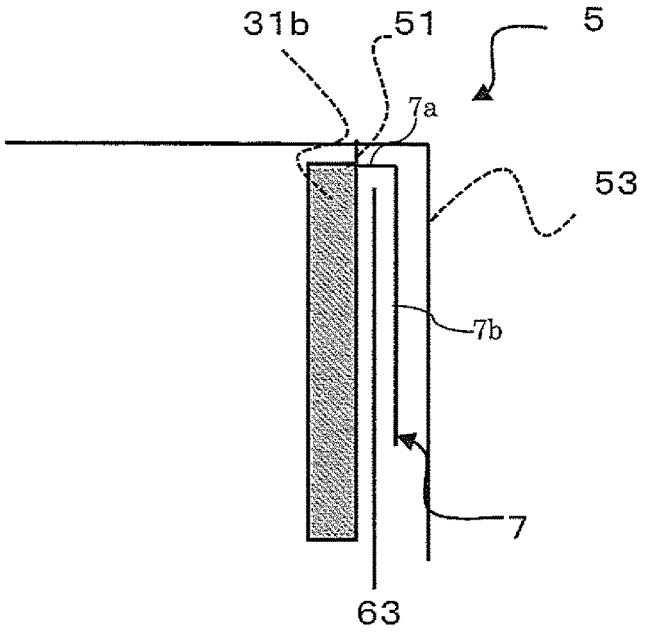
FIG. 7 is a schematic view showing an L-shape (third auxiliary) element installed on the side of the second bus bar.
Figure 11:
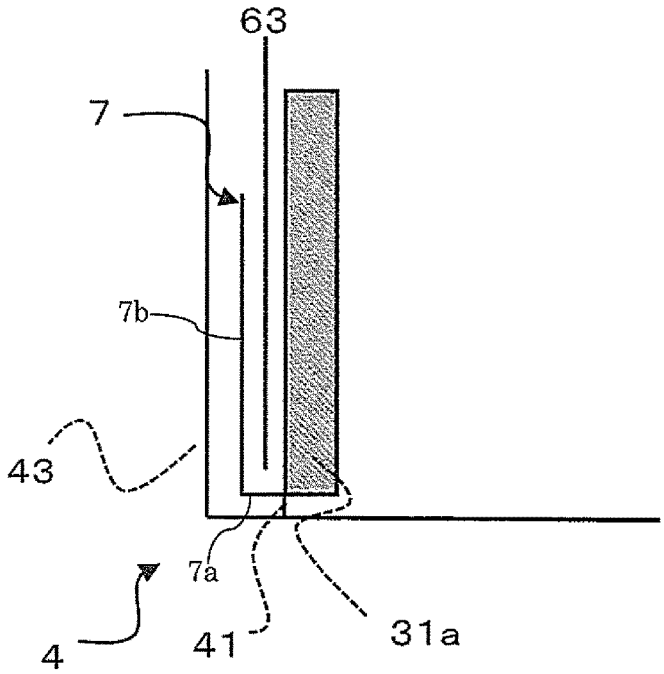
FIG. 11 is a view similar to FIG. 7, but showing an L-shape (third auxiliary) element installed on the side of the first bus bar.

As shown in FIGS. 7 and 11, the first or second bus bar 31*a*, 31*b*, on which the main element 6 having the main vertical element 63 is arranged, may be provided with the L-shape, third auxiliary element 7 that is in a capacitive coupling with the main vertical element 63. The L-shape (third auxiliary) element 7 has (1) a first strip 7*a* that extends in the horizontal direction from the upper end of the second bus bar 31*b* or from the lower end of the first bus bar 31*a* and (2) a second strip 7*b* that extends from an end of the first strip in a vertical direction to be parallel with the main vertical element 63 of the main element 6. It is preferable to have a distance of 3-15 mm between the second strip 7*b* of the third auxiliary element 7 and the main vertical element 63 of the main element 6, and the each length of these (i.e., the second strip 7*b* and the main vertical element 63)

opposed to each other is preferably 10-200 mm. By having a capacitive coupling between the third auxiliary element 7 and the main vertical element 63, electric signals of FM radio broadcast waves received by the defogger 3 are easily transmitted to the main element 6, thereby improving the reception sensitivity of FM radio broadcast waves.

3. Main Element

Figure 8:
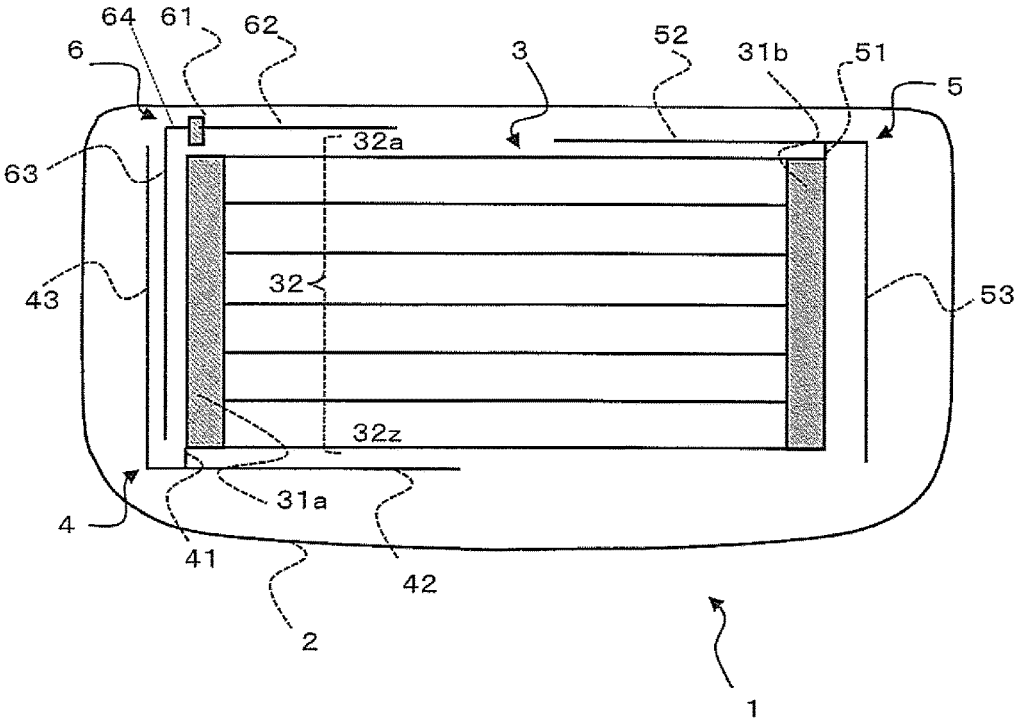
FIG. 8 is a view similar to FIG. 1, but showing a state in which the main element is provided on the side of the first auxiliary element.
Figure 9:
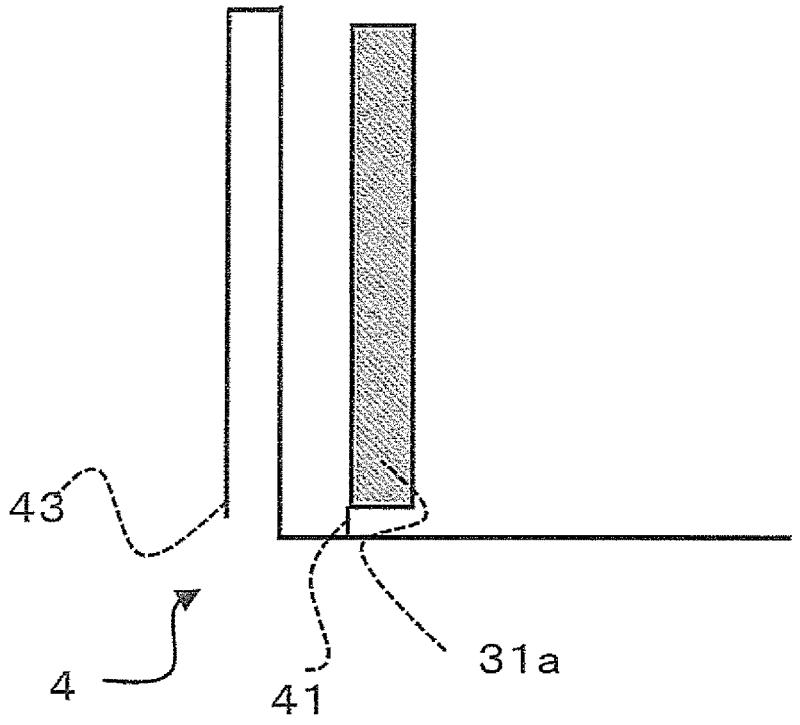
FIG. 9 is a schematic view showing a modification of the first auxiliary vertical strip in the first auxiliary element.

The main element 6 is equipped with (1) a feed point 61 provided at a position that is near an upper portion of the first bus bar 31*a* (see FIG. 8) or near a lower portion of the second bus bar 31*b* (see FIG. 1), (2) a main vertical element 63 that extends along an outside of the first or second bus bar 31*a*, 31*b* to achieve a capacitive coupling with the first or second bus bar 31*a*, 31*b*, and (3) a main horizontal element 62 that extends from the feed point 61 in a substantially horizontal direction. As shown in FIGS. 1 and 8, it is optional to connect the main vertical element 63 with the feed point 61 via an element 64 or to make the main vertical element 63 directly extend from the feed point 61.

A terminal (not shown in the drawings) is installed on the feed point by a method such as soldering. When installing the window glass 2 in a hatchback-type rear door, the glass antenna 1 is connected to a radio receiver, an amplifier, etc. through the feed point 61, the terminal, and a core wire. The length of each strip of the main element 6 is suitably adjusted in view of the target wavelengths of FM radio broadcast waves to be received and the size of the defogger 3. The length of the main vertical element 63 is preferably 100-500 mm. The main vertical element 63 is substantially parallel with the first bus bar 31*a* (see FIG. 8) or the second bus bar 31*b* (see FIG. 1), and the distance therebetween is preferably 3-15 mm to achieve a capacitive coupling therebetween. The main vertical element 63 has a portion that is opposed to the first or second bus bar 31*a*, 31*b* to achieve a capacitive coupling therebetween. This portion of the main vertical element has a length of preferably 50-450 mm, more preferably 150-400 mm, to easily transmit electric signals of FM radio broadcast waves received by the defogger 3 to the main element 6. The main horizontal element 62 extending from the feed point 61 in a substantially horizontal direction toward the inner side of the window glass 2 has a length of preferably 50-400 mm.

It is clear that a structure in which the main element 6 is arranged on the side of the first bus bar 31*a* (see FIG. 8) can be obtained by rotating a structure in which the main element 6 is arranged on the side of the second bus bar 31*b* (see FIG. 1) by 180 degrees.

In the present invention, a glass antenna can be formed by printing the above-mentioned defogger's strips, bus bars, and main element's strips on a glass plate surface and then baking.

EXAMPLES

Example 1

FIG. 12 is a schematic of an antenna pattern according to Example 1 of the present invention, viewed from the car interior. A window glass 2 is used for a hatchback-type rear door and is a glass prepared by a three dimensional bending process to have a curved shape that is convex toward the car exterior. The window glass 2 is formed at its peripheral portion with a black frame 21 colored with a black-color ceramic. The first and second bus bars 31*a*, 31*b*, the first and second auxiliary elements 4, 5, and the main element 6 are arranged in the black frame so that these members are not visible to the car occupants and others once the window glass 2 is installed in a car. The window glass 2 was 590 mm as the longest length in the vertical direction, and 1,250 mm as the longest length in the horizontal direction.

Figure 16:
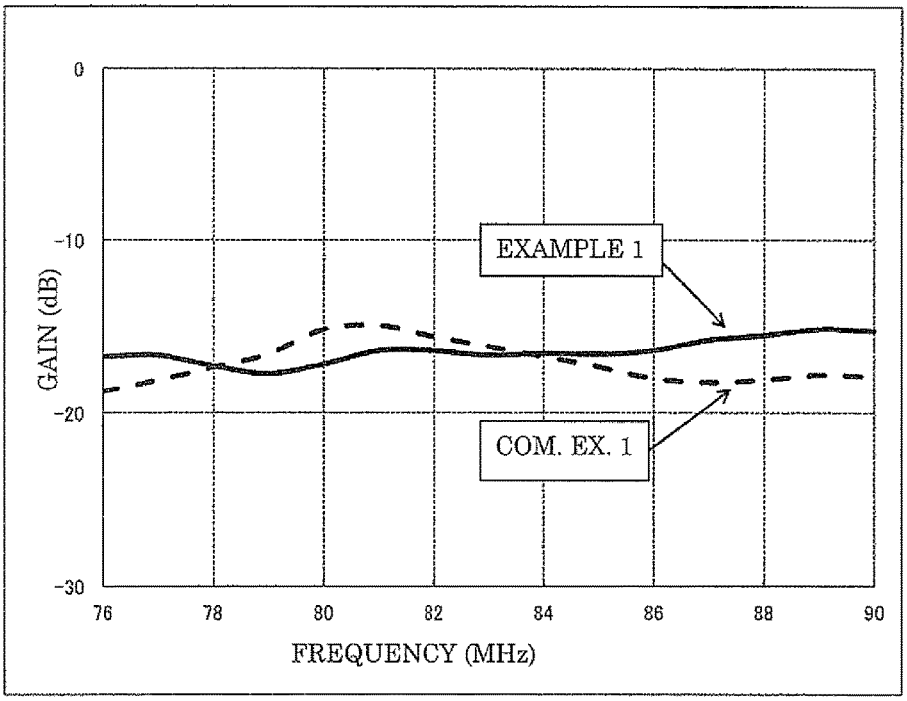
FIG. 16 is a graph showing frequency characteristics of glass antennas according to Example 1 and Comparative Example 1.

Dimensions of each structure were as follows. The width of each strip was 0.5 mm. The first and second bus bars 31*a*, 31*b*, the first and second auxiliary elements 4, 5, and the main element 6 were formed by printing a silver paste on the surface of the window glass 2 and then baking. A connector terminal (not shown in the drawings) was connected to the feed point 61 by soldering. A core wire was attached to the connector, and the glass antenna 1 and a radio receiver were connected via the core wire, thereby making a radio receiver. Using this radio receiver, the reception sensitivity of FM broadcast wave band (76-90 MHz) in Japan was measured. As shown in FIG. 16, the reception sensitivity was good throughout the band.

Defogger 3

First and second bus bars 31*a*, 31*b*: 15 mm in width and 285 mm in length (both bus bars were rectangular in shape and had the same dimensions).

Length of horizontal heating strips 32: 980 mm

Distance between two adjacent horizontal heating strips 32: 35 mm

First Auxiliary Element 4

Length of extension line 41: 20 mm

Length of first auxiliary horizontal strip 42: 450 mm

Length of first auxiliary vertical strip 43: 530 mm

Distance between first auxiliary vertical strip 43 and first bus bar 31*a*: 10 mm Second Auxiliary Element 5

Length of extension line 51: 10 mm

Length of second auxiliary horizontal strip 52: 190 mm

Length of second auxiliary vertical strip 53: 200 mm

Distance between second auxiliary vertical strip 53 and second bus bar 31*b*: 30 mm Main Element 6

Feed point 61: a rectangular shape having a base of 10 mm and a height of 20 mm Distance between the lower end of the second bus bar 31*b* and the upper end of the feed point 61: 45 mm Length of main vertical element 63: 290 mm Distance between main vertical element 63 and second bus bar 31*b*: 10 mm Length of main horizontal element 62: 375 mm

Example 2

FIG. 13 is a schematic of an antenna pattern according to Example 2 of the present invention, viewed from the car interior. This antenna pattern was identical with that according to Example 1, except in that the distance between the upper end of the first bus bar 31*a* and the lower end of the feed point was 10 mm. The glass antenna according to Example 2 showed antenna characteristics similar to those of Example 1.

Example 3

An antenna pattern according to Example 3 of the present invention was identical with that according to Example 1, except in that an L-shape (third auxiliary) element 7 as shown in FIG. 7 was formed and that the dimensions of the second auxiliary element 5 and the L-shape (third auxiliary) element 7 were set as follows. The glass antenna according to Example 3 showed antenna characteristics similar to those of Example 1.

Second Auxiliary Element 5

Length of extension line 51: 10 mm

Length of second auxiliary horizontal strip 52: 190 mm

Length of second auxiliary vertical strip 53: 200 mm

Distance between second auxiliary vertical strip 53 and second bus bar 31*b:* 30 mm L-shape (third auxiliary) element 7

Length of a first strip 7*a* extending right in the horizontal direction from the top right corner of the second bus bar 31*b:* 30 mm Length of a second strip 7*b* extending from an end of the first strip 7*a* in the vertical direction: 350 mm Length of a portion of the second strip 7*b*, which portion is opposed to the main vertical element 63: 160 mm Example 4

Figure 17:
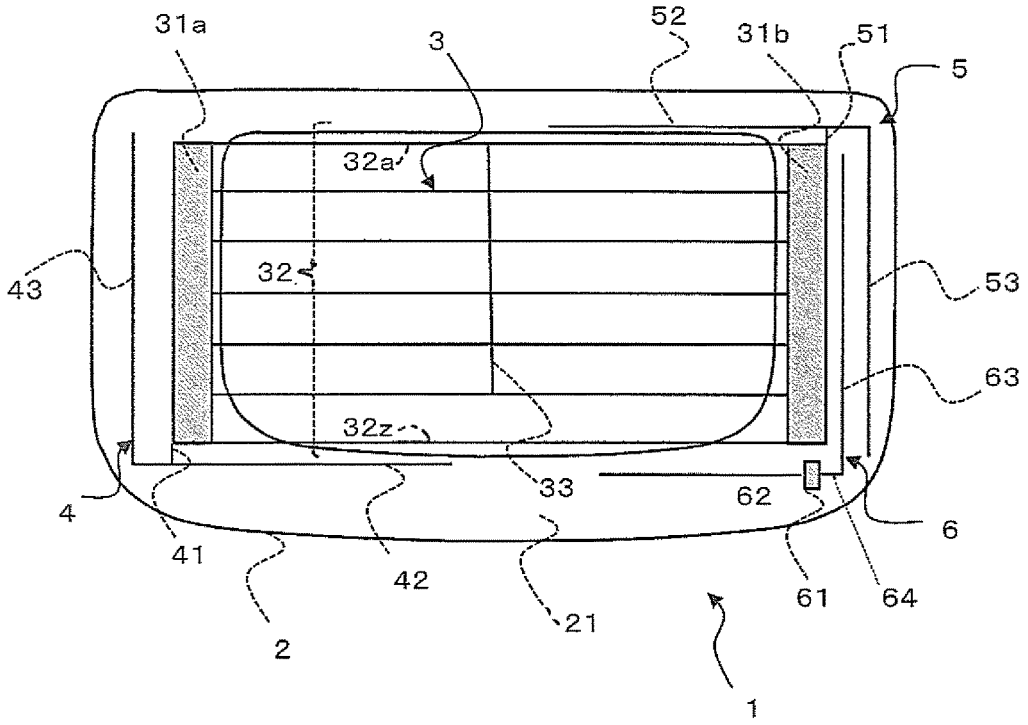
FIG. 17 is a schematic view showing a glass antenna of Example 4.
Figure 19:
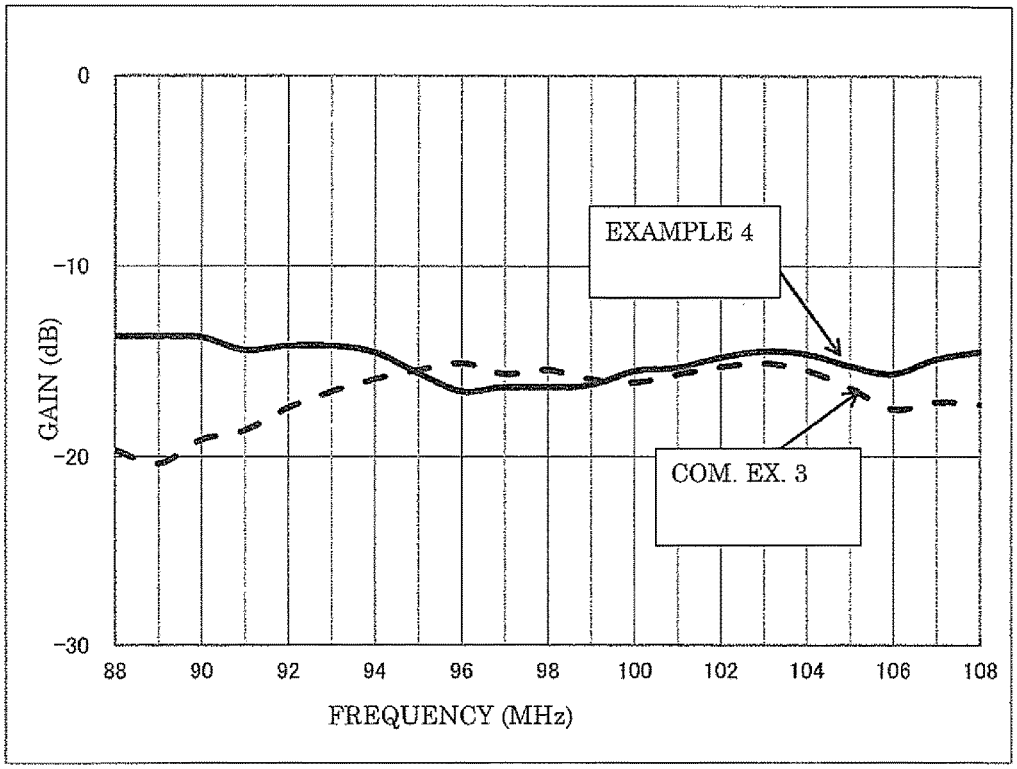
FIG. 19 is a graph showing frequency characteristics of glass antennas according to Example 4 and Comparative Example 3.

FIG. 17 is a schematic of an antenna pattern according to Example 4 of the present invention, viewed from the car interior. This antenna pattern was identical with that according to Example 1, except in that a vertical heating strip 33 as shown in FIG. 2 was formed at a position to bisect the horizontal heating strips 32. The vertical heating strip 33 extended from the uppermost horizontal heating strip 32*a* to the second lowermost horizontal heating strip. The reception sensitivity of FM broadcast wave band (88-108 MHz) in foreign countries, such as USA, was measured. As shown in FIG. 19, the reception sensitivity was good throughout the band.

Comparative Example 1

Figure 14:
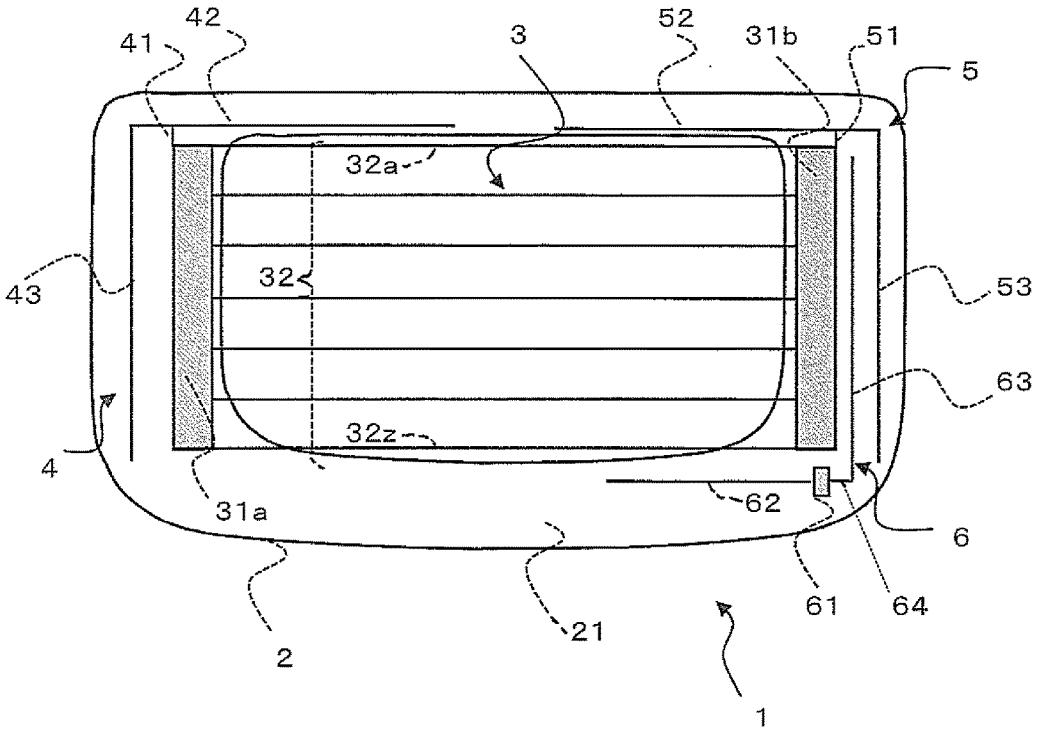
FIG. 14 is a schematic view showing a glass antenna of Comparative Example 1.

FIG. 14 is a schematic of an antenna pattern according to Comparative Example 1 of the present invention, viewed from the car interior. This antenna pattern was identical with that according to Example 1, except in that both of the first and second auxiliary elements 4,5 were respectively connected to the upper ends of the first and second bus bars 31*a*, 31*b*. The reception sensitivity of FM broadcast wave band (76-90 MHz) in Japan was measured. As shown in FIG. 16, the reception sensitivity varied more for each frequency as compared with Example 1.

Comparative Example 2

Figure 15:
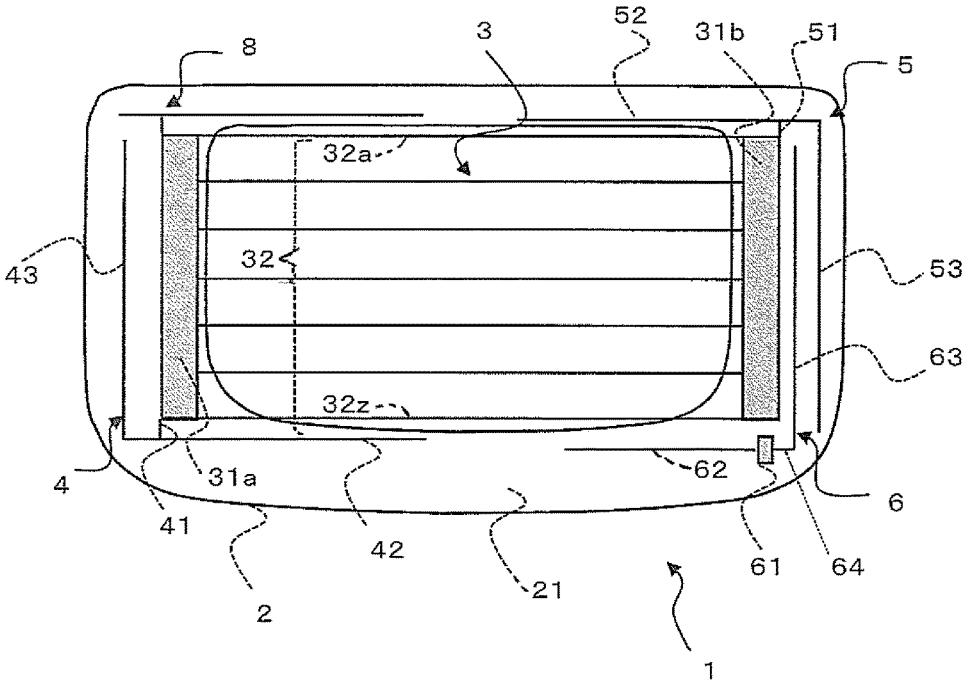
FIG. 15 is a schematic view showing a glass antenna of Comparative Example 2.

FIG. 15 is a schematic of an antenna pattern according to Comparative Example 2 of the present invention, viewed from the car interior. This antenna pattern was identical with that according to Example 1, except in that a T-shaped auxiliary element 8 was connected to the upper end of the first bus bar 31*a*. The glass antenna according to Comparative Example 2 showed antenna characteristics similar to those of Comparative Example 1.

Comparative Example 3

Figure 18:
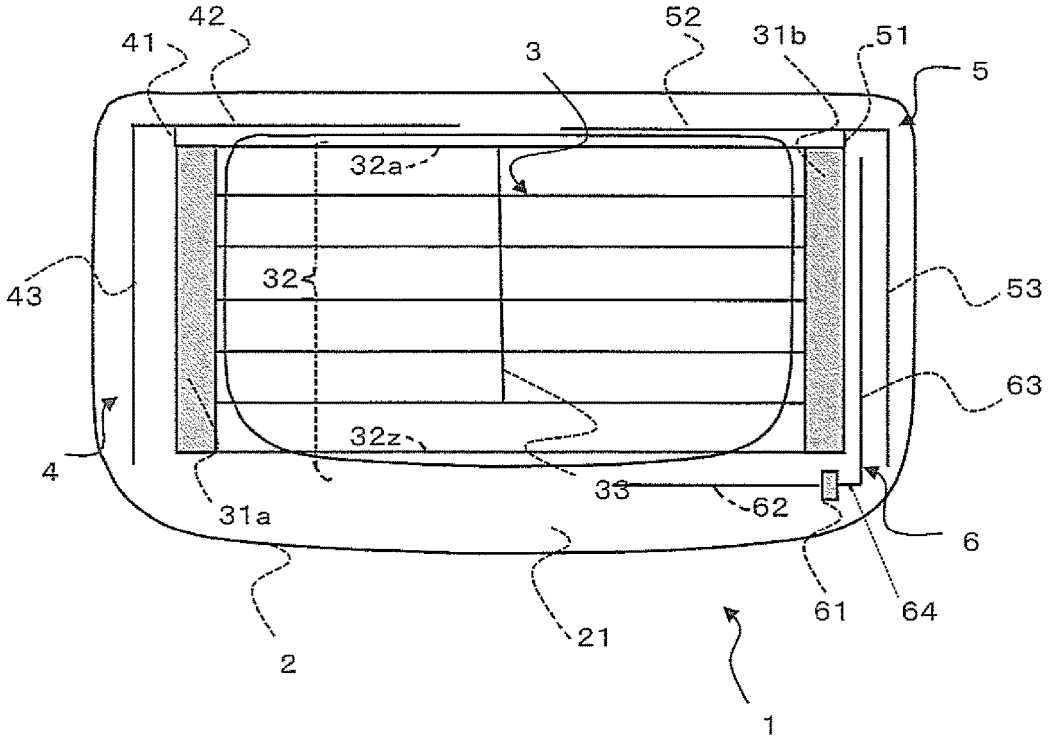
FIG. 18 is a schematic view showing a glass antenna of Comparative Example 3.

FIG. 18 is a schematic of an antenna pattern according to Comparative Example 3 of the present invention, viewed from the car interior. This antenna pattern was identical with that according to Comparative Example 1, except in that a vertical heating strip 33 as shown in FIG. 18 was formed at a position to bisect the horizontal heating strips 32. The vertical heating strip 33 extended from the uppermost horizontal heating strip 32*a* to the second lowermost horizontal heating strip. The reception sensitivity of FM broadcast wave band (88-108 MHz) in foreign countries, such as USA, was measured. As shown in FIG. 19, the reception sensitivity varied more for each frequency as compared with Example 4.

The invention claimed is:

1. An automotive glass antenna for receiving FM radio broadcast waves to be installed on a hatchback rear window glass, comprising:

(a) a defogger including horizontal heating strips and first and second bus bars arranged at both end portions of the horizontal heating strips;

(b) a first auxiliary element including:

(1) a first auxiliary horizontal strip that is directly connected to a lower end of the first bus bar only through a first extension line and extends along the lowermost horizontal heating strip, the first extension line being separate from the lowermost horizontal heating strip, and (2) at least one first auxiliary vertical strip that extends upwardly from the first auxiliary horizontal strip in a substantially vertical direction to be outwardly away from the first bus bar;

(c) a second auxiliary element including:

(1) a second auxiliary horizontal strip that is directly connected to an upper end of the second bus bar only through a second extension line and extends along the uppermost horizontal heating strip, the second extension line being separate from the uppermost horizontal heating strip, and (2) at least one second auxiliary vertical strip that extends downwardly from the second auxiliary horizontal strip in a substantially vertical direction to be outwardly away from the second bus bar; and (d) a main element including:

(1) a feed point provided at a position that is near an upper portion of the first bus bar or near a lower portion of the second bus bar, (2) a main vertical element that is connected with the feed point and extends along an outside of the first or second bus bar to achieve a capacitive coupling with the first or second bus bar, and (3) a main horizontal element that extends from the feed point in a substantially horizontal direction.

2. The automotive glass antenna as claimed in claim 1, wherein the main vertical element is in a capacitive coupling with the at least one first or second auxiliary vertical strip of the first or second auxiliary element.

3. The automotive glass antenna as claimed in claim 1, wherein at least one of the first and second auxiliary elements comprises an L-shape element including:

(1) a first strip that extends in a horizontal direction from the lower end of the first bus bar or from the upper end of the second bus bar, and (2) a second strip that extends from an end of the first strip in a vertical direction to be parallel with the main vertical element of the main element.

4. The automotive glass antenna as claimed in claim 1, wherein the defogger comprises at least one vertical heating strip that connects with the horizontal heating strips except the lowermost horizontal heating strip.

* * * * *